United States Patent [19]

Hronas

[11] 3,986,695

[45] Oct. 19, 1976

[54] CONTAINER AND SUPPORT

[76] Inventor: John J. Hronas, 3161 Mulberry St., Erie, Pa. 16415

[22] Filed: June 13, 1975

[21] Appl. No.: 584,683

[52] U.S. Cl. ..... 248/223; 211/74; 248/DIG. 3

[51] Int. Cl.[2] ..... A47F 5/00

[58] Field of Search ..... 248/223, 224, 225, DIG. 3; 211/74, 75, 76, 77

[56] References Cited

UNITED STATES PATENTS

| | | | |
|---|---|---|---|
| 2,557,801 | 6/1951 | Shapiro | 211/75 |
| 3,027,036 | 3/1962 | Budreck | 248/DIG. 3 |
| 3,198,469 | 8/1965 | Callanan | 248/DIG. 3 |
| 3,209,935 | 10/1965 | Long | 248/DIG. 3 |
| 3,222,023 | 12/1965 | Schweitzer | 248/DIG. 3 |
| 3,224,594 | 12/1965 | Schweitzer | 248/223 |
| 3,339,814 | 9/1967 | Carbine | 248/223 |
| 3,516,552 | 6/1970 | Salava | 248/DIG. 3 |
| 3,516,634 | 6/1970 | Salava et al. | 248/DIG. 3 |

*Primary Examiner*—Robert A. Hafer

[57] ABSTRACT

A combination cover support and container cover, made up of an elongated bar, generally rectangular in cross section, having a front, top, rear and bottom surface is disclosed. Two vertically spaced, longitudinally extending slots are formed in the front face of said bar and a single longitudinally extending slot is formed in the rear face of the bar. The single slot in the rear of the bar is substantially the same width and disposed directly behind the first mentioned slot and the front face, forming a web between the front slot and the rear slot and spaced pairs of holes formed in this web. These holes are spaced downwardly from the top surface of the slots so that hooks on the container support can extend through the pairs of holes and lay behind the rear surface of the slots.

1 Claim, 5 Drawing Figures

CONTAINER AND SUPPORT

OBJECTS OF THE INVENTION

It is an object of the invention to provide an improved container support.

Another object of the invention is to provide an improved container support bar and container covers.

Another object of the invention is to provide a container support that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF DRAWING

DETAILED DESCRIPTION OF DRAWING

Figure 1:
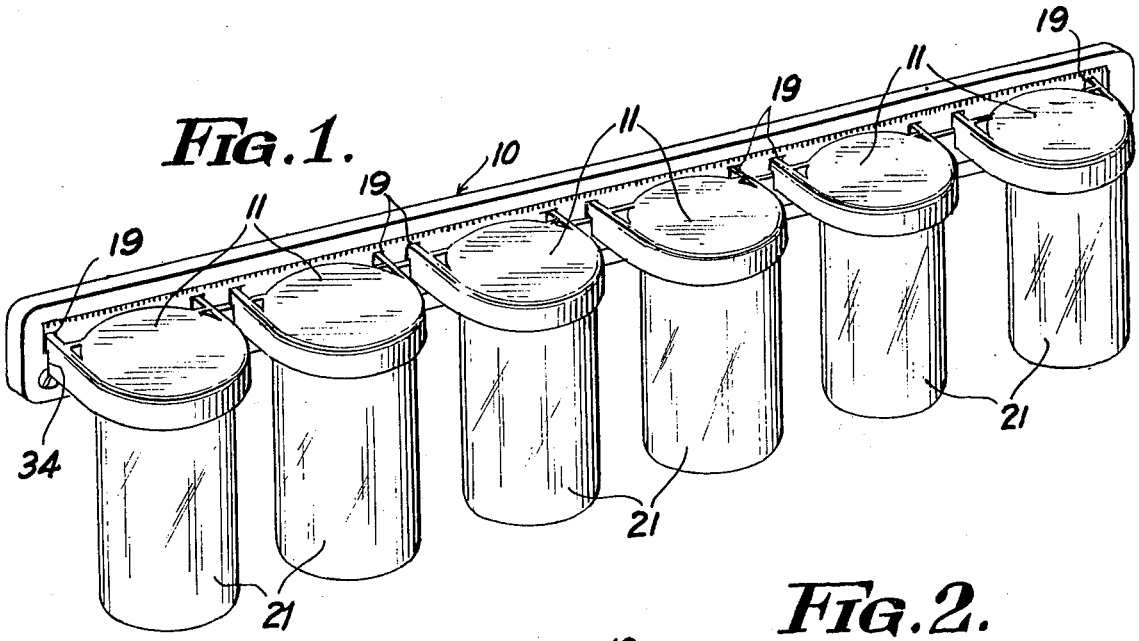
FIG. 1 is an isometric view of the support bar and container covers supported thereon.
Figure 2:
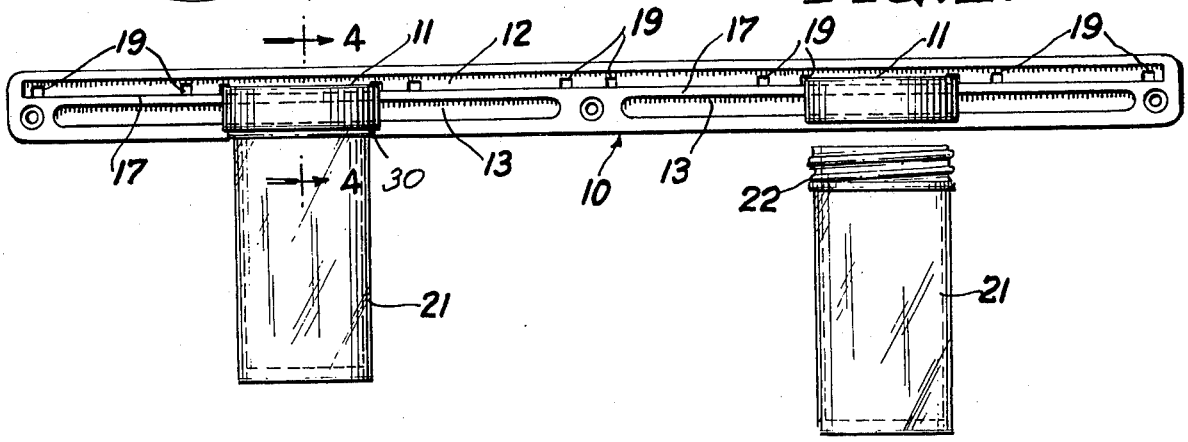
FIG. 2 is a front view of the support bar and containers shown in FIG. 1, with some of the containers removed.
Figure 5:
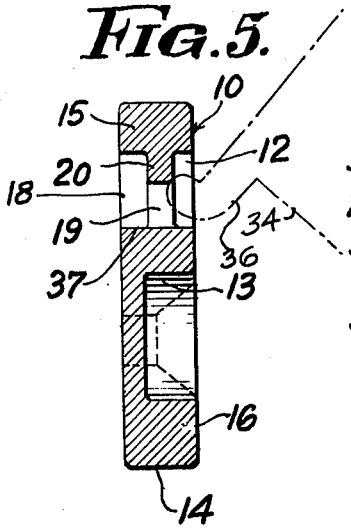
FIG. 5 is a cross sectional view taken on line 4—4 of FIG. 2.
Figure 4:
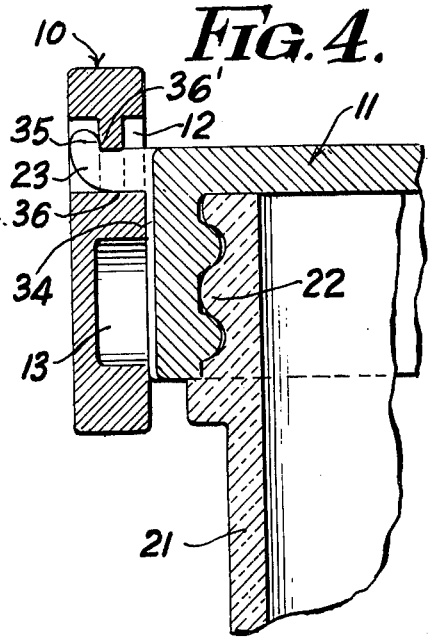
FIG. 4 is a longitudinal cross sectional view of the container support and support bar taken on line 4—4 of FIG. 2.
Figure 3:
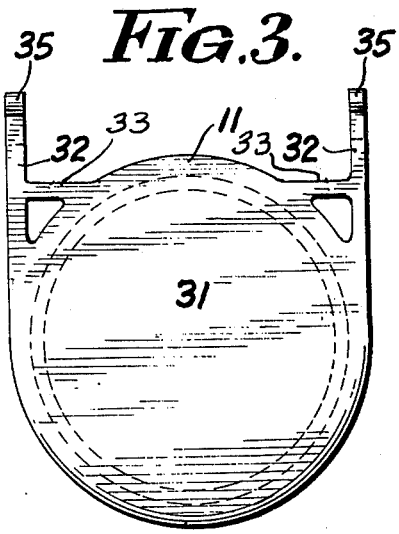
FIG. 3 is a top view of one of the container supports.

Now with more particular reference to the drawings, a support bar 10 is shown, supporting the container covers 11 which have the containers 21 supported on them by the threaded necks 22. The containers can be of the familiar transparent type familiar to those skilled in the art, for supporting small articles such as nuts, bolts and washers in a shop. The bar is generally rectangular in cross section, as shown in FIG. 5, with a bottom surface 14, a top surface 15, front surface 16 and rear surface.

The bar has the longitudinally extending slot 12 spaced from the top surface 15 and extending from substantially one end to the other of the bar. A plurality of longitudinally spaced slots 13 are formed in the front surface 16 of the bar, with a depth substantially equal to twice the depth of the first mentioned slot 12. A fourth longitudinally extending slot 18 is formed in the rear surface of the bar and this slot and slot 12 provides the web 20 therebetween. The web 20 has spaced holes 19 formed in it. These holes receive the hooks 23 of the covers 11.

The containers 21, having the threaded necks 22, are received in the internally threaded rim 30 of the support 11. The rim 30 has a generally flat top surface 31 and rearwardly extending space brackets 32, are attached to the covers 11 and have the gussett members 33 connecting the brackets to the rear of the covers 11. The rear edge of the brackets 32 have the shoulder 34 and upwardly extending hook ends 35. The hook ends 35 have a generally flat lower surface 36, which rests on the surface 37 which defines the lower side of the slots 12 and 18.

It will be noted that the bottom surface defining the openings 19 is flush with the bottom surface of the slot 18 and the bottom surface of the slot 12, so that the flat surface 36 of the hook rests on this flat surface when the containers are in position. The flat surface 34 of the brackets 32 rests against the front surface 16 of the bar.

The hook ends 35 have a forwardly facing surface which extends upwardly behind the web 20 and holds the container support cover 11 in place.

The container covers may be supported on the front of an aperture panel such as peg board or any other suitable supporting surface having spaced holes in it. The shoulder 36' on the hook engages the web 20 on aforesaid surface 34 of the bracket, which rests against the front surface 16 of the container support.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, an apertured support bar having spaced holes for receiving hooks, a container and a support cap, said container having a cuplike body terminating in a threaded neck, said support cap comprising a closed top and a threaded rim adapted to receive said container, a first relatively thin plate-like bracket integrally attached to one side of said closed top and a second relatively thin plate-like bracket integrally attached to the other side of said closed top, each said plate-like bracket terminating at its rear end in an upwardly extending integrally attached hook member extending upwardly from the upper edge of said bracket, and having a front surface disposed generally perpendicular to the bottom edge of said brackets, and a shoulder on the rear end of said brackets defined by a vertically extending surface spaced toward said cap from said hook a distance less than the thickness of said apertured support bar and adapted to engage the front edge of said apertured support bar, and a flat edge on the bottom side of said bracket, below said hook and disposed above and generally parallel to the bottom edge of said aperture and extending from said shoulder to the rear edge of said hook whereby when said hooks extend through holes in said apertured support bar, said flat edge rests on the bottom of said aperture, the top of said brackets being generally flush with the top surface of said cap, and said rim engaging said support bar limiting the downward movement of said cap, said support bar comprising an elongated bar having a front, bottom, top, and a flat planar rear surface on said bar, defining a generally rectangular cross sectional member, a longitudinally extending first slot in the front surface of said bar, extending approximately one-third of the way through said bar, and adjacent to said top surface of said bar, a plurality of longitudinally spaced, longitudinally extending, second slots in the front surface of said bar, spaced from the bottom surface of said bar and spaced downwardly from said first mentioned slot, defining a land surface therebetween, a third longitudinally extending slot in the rear surface of said bar, said third slot being substantially equal in width to said first mentioned slot and extending approximately one-third of the way through said bar, said first mentioned slot and said third slot defining a web therebetween, longitudinally spaced pairs of holes in said web surface, spaced from the upper surface thereof, said pair of holes being spaced equally to the spacing of said hook members on said container, said hook members on said container, extending through said holes and up into said third mentioned slot, over said web holding said containers in position, said brackets each have a flat edge disposed below said hooks and above and generally parallel to the bottom edge of said bracket and extending from said shoulder to the rear edge of said hook whereby when said hooks extend through holes in said apertured support bar, and said forwardly facing vertical surface on said brackets engaging the rear side of the said web, and said rearwardly facing vertical surface on said brackets engages the front side of said support bar, the top of said brackets being generally flush with the top surface of said cap, and said rim engaging said support bar limiting the downward swinging movement of said cap and terminates substantially at the lower edge of said support bar.

* * * * *